US005782108A

United States Patent [19]

Cannata et al.

[11] Patent Number: 5,782,108

[45] Date of Patent: Jul. 21, 1998

[54] SPRINGLESS JEWELRY FINDING

[75] Inventors: Christopher J. Cannata, Cranston, R.I.; Maria H. Garcia, Attleboro, Mass.

[73] Assignee: Leach & Garner Company, North Attleboro, Mass.

[21] Appl. No.: 844,436

[22] Filed: Apr. 18, 1997

[51] Int. Cl.[6] ..... A44C 15/00

[52] U.S. Cl. ..... 63/35; 63/14.4

[58] Field of Search ..... 63/35, 12, 14.1, 63/14.4; 24/599.9, 518

[56] References Cited

U.S. PATENT DOCUMENTS

| | | | |
|---|---|---|---|
| 1,557,495 | 10/1925 | Griffin | 24/599.9 |
| 2,618,831 | 11/1952 | Gloss | 24/518 |
| 3,309,743 | 3/1967 | Verri | 24/599.9 |
| 5,644,823 | 7/1997 | Montaquila | 24/499 |

*Primary Examiner*—Kien T. Nguyen

*Attorney, Agent, or Firm*—Phillips, Lytle, Hitchcock, Laine & Huber LLP

[57] ABSTRACT

A springless jewelry finding (25) includes an hinge plate (26) and an ear-wire (28) having one marginal end portion (34) secured to the hinge plate, having an intermediate arcuate portion (35) and having a distal marginal end portion (36). A lever-paddle (29) has one marginal end portion (38) pivotally mounted on the hinge and has another marginal end portion (39) mounted for arcuate movement toward and away from the ear-wire distal marginal end portion. The lever-paddle other marginal end portion has a concave surface that is adapted to selectively embrace the ear-wire distal marginal end portion and has a detent (40) that is so configured and dimensioned with respect to the ear-wire distal marginal end portion as to require that the ear-wire distal marginal end portion be forcibly passed through the detent as the lever-paddle is moved between opened and closed positions relative to the ear-wire. When the lever-paddle is in its closed position, the detent will prevent the lever-paddle other marginal end portion from freely moving away from the ear-wire distal marginal end portion.

4 Claims, 1 Drawing Sheet

SPRINGLESS JEWELRY FINDING

TECHNICAL FIELD

The present invention relates generally to the field of jewelry findings, and, more particularly, to an improved finding for use in attaching an earring to a person's ear and which eliminates the need of a spring between a lever-paddle and an ear-wire.

BACKGROUND ART

A jewelry finding is a comparatively small device that is typically used to attach an item of jewelry to some other object. For example, a finding is used to attach an earring to a person's earlobe. This is not the only use for a finding, but is the immediate use of interest here.

Prior art earring findings included five parts: a hinge plate, an ear-wire, a rivet, a lever-paddle and a leaf spring acting between the lever-paddle and the hinge plate so as to create a toggle-like action therebetween. In other words, the spring was a type of over-center mechanism that caused the lever-paddle to be stable in an opened condition, at which the lever-paddle was displaced away from the ear-wire, or a closed position at which the lever-paddle embraced the distal end of the ear-wire and closed the loop formed therein. While such devices were common, they sometimes required that the spring be heat-treated, and that the spring be soldered or otherwise secured to the lever-paddle. The soldering of an earring or some other ornamentation to the finding also tends to soften the spring.

It would, therefore, be generally desirable to provide a functional jewelry finding that would eliminate the need for a spring. Such elimination of an element, while retaining its function, has been held to be a patentable improvement in Lawther v. Hamilton, 124 U.S. 1 (1888).

DISCLOSURE OF THE INVENTION

With parenthetical reference to the corresponding parts, portions or surfaces of the disclosed embodiment, merely for purposes of illustration and not by way of limitation, the present invention provides an improved springless jewelry finding (25). The improved finding broadly comprises: a hinge plate (26); an ear-wire (28) having one marginal end portion (34) secured to the hinge plate by means of a pin or rivet which passes through the holes in the marginal end portions of the lever-paddle (38) and the hinge plate extension (32), having an intermediate arcuate portion (35), and having a distal marginal end portion (36); and a lever-paddle (29) having one marginal end portion (38) pivotally mounted on the hinge plate and having another marginal end portion (39) mounted for arcuate movement toward and away from the distal marginal end portion (36) of the ear-wire, the lever-paddle other marginal end portion having a generally concave cross-sectional surface that is adapted to selectively embrace the ear-wire distal marginal end portion and having a detent (40) that is so configured and dimensioned with respect to the ear-wire distal marginal end portion as to require that the ear-wire distal marginal end portion be forcibly passed through the detent (i.e., by compliant flexure and deformation of the walls (41, 41) defining the detent) as the lever-paddle is moved between opened and closed positions relative to the ear-wire; whereby when the lever-paddle is in the closed position, the detent will prevent the lever-paddle other end portion from freely moving away from the ear-wire distal marginal end portion.

In the preferred embodiment, the detent is defined as a narrowed space between opposing walls of the lever-paddle other marginal end portion, with the distance between these opposing walls being less than the greatest outer transverse dimension of the ear-wire distal marginal end portion. These walls may flex to accommodate passage of the distal marginal end portion of the ear-wire through the detent. In the preferred embodiment, the finding may make an audible "click" as the distal marginal end portion passes through the detent.

Accordingly, the general object of the invention is to provide an improved springless jewelry finding.

Another object is to provide an improved jewelry finding which eliminates the use for a spring, which is entirely made of precious metal, which offers a significant weight reduction, and which reduces assembly time and cost.

Another object is to provide an improved jewelry finding that is made either by partially or wholly using a heat treatable alloy, such as or similar to that described and claimed in U.S. Pat. No. 5,180,551, the aggregate disclosure of which is hereby incorporated by reference.

Another object is to provide an improved springless jewelry finding in which there is no spring to anneal if the spring were to be soldered to a portion of the finding, in which there is no spring to fall out by poor assembly, and in which there is no spring to drag or bind the closure operation.

Still another object is to provide an improved springless jewelry finding in which a person may perceive a locking effect due to a snap-type engagement and disengagement.

These and other objects and advantages will become apparent from the foregoing and ongoing written specification, the drawings, and the appended claims.

DESCRIPTION OF THE PREFERRED EMBODIMENTS

Figure 1:
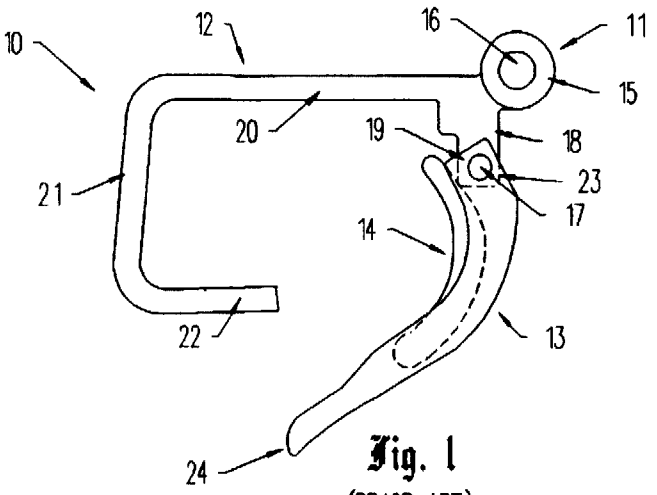
Fig. 1 (PRIOR ART)
FIG. 1 is a fragmentary side elevation of a prior art jewelry finding having an ear-wire, a hinge plate, a rivet/pin, a lever-paddle and a leaf spring, this view showing the finding as being in an opened condition.

At the outset, it should be clearly understood that like reference numerals are intended to identify the same structural elements, portions, or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up", and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Figure 2:
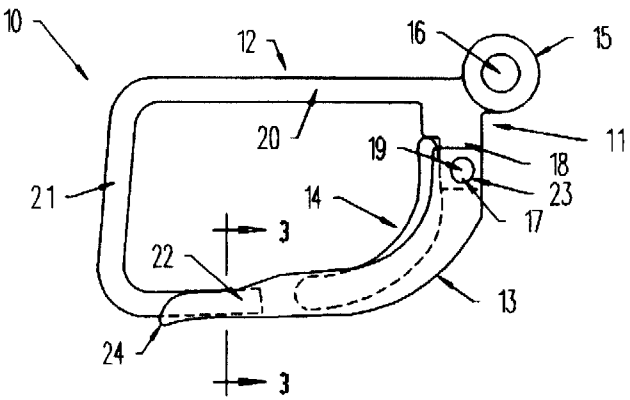
Fig. 2 (PRIOR ART)
FIG. 2 is a side elevation of the prior art finding shown in FIG. 1, although showing the finding in a closed condition.
Figure 3:
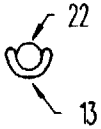
Fig. 3 (PRIOR ART)
FIG. 3 is a fragmentary transverse vertical sectional view thereof, taken generally on line 3—3 of FIG. 2, and showing the marginal end portion of the lever-paddle as embracing the distal end of the ear-wire.

Prior Art Finding (FIGS. 1–3)

Referring now to the drawings, and more particularly to FIGS. 1–3 thereof, a prior art jewelry finding is generally indicated at 10. This finding is shown as broadly including a hook-shaped member having a hinge plate 11, an ear-wire 12, a pin or rivet 17 provided through hole 19, a lever-paddle 13, and a leaf spring 14. The hinge plate is shown as having a gazebo-shaped lug 15 provided with a hole 16. Hole 16 is provided so that other portions of the item of jewelry (not shown) may be selectively attached to the finding. The lever portion 13 is also shown as having an extension 18 provided with another hole 19.

The ear-wire 12 is shown as being a generally hook-shaped member having a first portion 20 mounted on and extending away from the hinge plate, having an reversely-curved intermediate portion 21, and having a distal marginal end portion 22. The ear-wire portion (i.e., portions 20, 21 and 22) is typically formed of a wire having a circular cross-section. The distal marginal end portion 22 of the ear-wire is adapted to be selectively passed through the earring hole in a person's ear lobe (not shown) in the conventional manner.

The lever-paddle 13 is shown as being an arcuate member having one marginal end portion 23 pivotally mounted on the hinge portion and having a distal fingernail tab 24. As best shown in FIG. 3, the lever-paddle has an arcuate transverse cross-section that includes a concave upper surface adapted to partially embrace the distal end of the ear-wire. The lever-paddle is mounted on the hinge plate for pivotal movement about the axis of hole 19. The lever-paddle may be selectively moved between an opened position, as shown in FIG. 1, and a closed position shown in FIG. 2.

The leaf spring 14 is mounted within the concavity of lever-paddle 13, and has a marginal end portion bearing against the corner of hinge plate extension 18. This creates a toggle-like over-center mechanism in which the lever-paddle is stable in either its fully-opened or fully-closed positions. When in its fully-closed position, spring 14 impedes the free arcuate movement of the lever-paddle toward its opened position.

In this prior art finding, the spring was typically formed of a base-metal, whereas the rest of the finding was formed of a precious metal. The spring represented an additional element that had to be assembled, contributed additional weight, increased assembly time and cost, and sometimes contributed to drag or binding. These disadvantages are eliminated in the improved embodiment.

Figure 4:
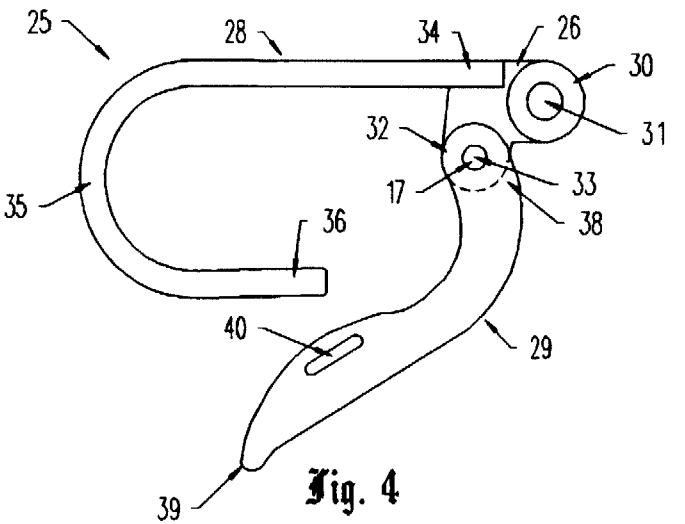
FIG. 4 is a side elevation of one form of an improved springless jewelry finding, this view showing the finding as including a hinge plate, an ear-wire, a pin or rivet, and a lever-paddle provided with a detent, this view showing the finding as being in its opened condition.
Figure 5:
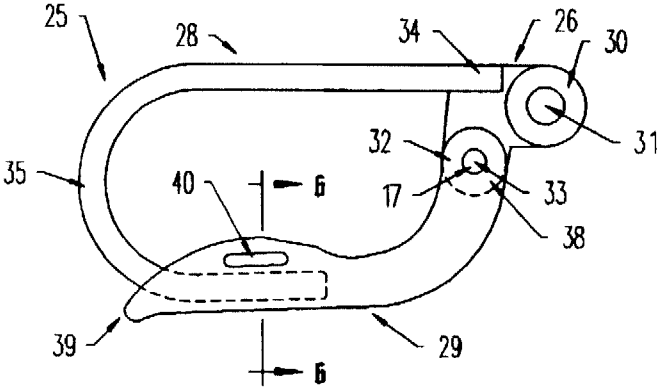
FIG. 5 is a side elevation of the springless finding shown in FIG. 4, but showing the finding in its closed condition.
Figure 6:
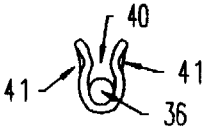
FIG. 6 is a fragmentary vertical sectional view thereof, taken generally on line 6—6 of FIG. 5, showing the distal marginal end portion of the ear-wire as having passed through the detent and being embraced by the marginal end portion of the lever-paddle.

Improved Springless Finding (FIGS. 4–6)

A preferred form of the improved springless finding is shown in FIGS. 4–6. In these views, the improved finding, generally indicated at 25, is shown as including a hinge plate 26, an ear-wire 28, and a lever-paddle 29. In FIGS. 4–6, the ear-wire is shown as being formed as an element separate from the hinge plate. The hinge plate is shown as having a lug portion 30 provided with a hole 31 by means of which the other items of jewelry may be attached to the finding. The hinge plate also has another extension 32 provided with a hole 33. Thus, lug portion 30 and hole 31 of the improved form are analogous to lug portion 15 and hole 16 of the prior art form.

The ear-wire 28 is shown as having one marginal end portion 34 secured to the hinge plate having an intermediate arcuate portion 35, and having a distal marginal end portion 36. As with the prior art embodiment, the ear-wire may typically be a length of wire having a generally circular transverse cross-section, although this may be readily changed or modified.

Lever-paddle 29 is shown as having one marginal end portion 38 pivotally mounted on the hinge portion for rotation about the axis of hole 33, and as having a fingernail tab 39 at its other marginal end. As with the prior art embodiment, the lever-paddle has a generally C-shaped transverse cross-section.

However, unlike the prior art embodiment, the improved device shown in FIGS. 4–6 does not have a spring as in the prior art. Rather, the improved device has a detent, generally indicated at 40. This detent is formed by striking inwardly portions of the opposing walls 41, 41 (see FIG. 6) of the lever-paddle so as to form a narrowed throat or constriction. The distance between these detent walls is less than the outer diameter of the ear-wire such that the ear-wire must forcibly pass through the detent as the paddle is moved between its fully-opened and fully-closed positions. Desirably, the improved device will actually make a snap-like "click" sound as the ear-wire passes through the detent, this audibly indicating to the wearer that the mechanism has been engaged or disengaged, as appropriate.

Thus, the preferred embodiment wholly eliminates the spring that had existed in the prior art embodiment. Nevertheless, the locking of the improved device is assured by means of the detent, and is accompanied by the audible sound when it is engaged and disengaged.

Modifications

The present invention contemplates that many changes and modifications may be made. It is presently perceived that the entire finding may be made out of a precious metal, such as an appropriate gold alloy. There is no longer a need for the additional spring, and hence a portion of the prior art may be wholly eliminated. As noted above, the ear-wire may be formed integrally with the hinge plate, or may be formed as a separate element subsequently assembled to the hinge plate. The hook-like shape and configuration of the ear-wire may be changed. The ear-wire need not necessarily have a circular cross-section. As illustrated in the drawings, the shape and configuration of the lever-paddle may also be changed. Generally, one marginal end portion is pivotally mounted on the hinge plate and other distal marginal end portion functions as a fingernail tab. The detent may be most conveniently formed by simply striking inwardly a portion of the side walls of the lever-paddle. Alternatively, it may be formed by physically attaching some additional structure to the lever-paddle. Of course, the shape and configuration of the various parts and components may be readily changed as desired.

Therefore, while the preferred form of the present invention has been shown and described, and several modifications thereof discussed, persons skilled in this art will readily appreciate that various additional changes and modifications may be made without departing from the spirit of the invention, as defined and differentiated by the following claims.

What is claimed is:

1. A springless jewelry finding comprising:

a hinge plate;

an ear-wire having one marginal end portion secured to said hinge plate, having an intermediate arcuate portion, and having a distal marginal end portion; and a lever-paddle having one marginal end portion pivotally mounted on said hinge plate and having another marginal end portion mounted for arcuate movement toward and away from said wire distal marginal end portion, said lever-paddle other marginal end portion having a concave surface that is adapted to selectively embrace said ear-wire distal marginal end portion and having a detent that is so configured and dimensioned with respect to said ear-wire distal marginal end portion as to require that said ear-wire distal marginal end portion be forcibly passed through said detent as said lever-paddle is moved between opened and closed positions relative to said ear-wire;

whereby when said lever-paddle is in said closed position, said detent will prevent said lever-paddle other marginal end portion from freely moving away from said ear-wire distal marginal end portion.

2. A springless jewelry finding as set forth in claim 1 wherein said lever-paddle has opposing walls, wherein said detent is defined between said opposing walls, and wherein the distance between said opposing walls is less than the outer dimension of said ear-wire distal marginal end portion.

3. A springless jewelry finding as set forth in claim 2 wherein said walls flex to accommodate passage of said ear-wire distal marginal end portion through said detent.

4. A springless jewelry finding as set forth in claim 1 wherein said finding makes an audible noise as said distal marginal end portion passages through said detent.

* * * * *